US011523726B2

(12) United States Patent
Fang

(10) Patent No.: US 11,523,726 B2
(45) Date of Patent: Dec. 13, 2022

(54) FLOOR CLEANING APPARATUS

(71) Applicant: NINGBO FUJIA INDUSTRIAL CO., LTD., Ningbo (CN)

(72) Inventor: Jianqiang Fang, Ningbo (CN)

(73) Assignee: NINGBO FUJIA INDUSTRIAL CO., LTD., Ningbo (CN)

( * ) Notice: Subject to any disclaimer, the term of this patent is extended or adjusted under 35 U.S.C. 154(b) by 346 days.

(21) Appl. No.: 16/819,119

(22) Filed: Mar. 15, 2020

(65) Prior Publication Data

US 2020/0297179 A1 Sep. 24, 2020

(30) Foreign Application Priority Data

Mar. 18, 2019 (CN) ..... 201910202088.8

(51) Int. Cl.

*A47L 11/40* (2006.01)
*A47L 11/283* (2006.01)
*A47L 13/08* (2006.01)

(52) U.S. Cl.

CPC ..... *A47L 11/4088* (2013.01); *A47L 11/283* (2013.01); *A47L 11/4069* (2013.01); *A47L 11/4083* (2013.01); *A47L 13/08* (2013.01); *A47L 2201/00* (2013.01)

(58) Field of Classification Search

CPC ..... A47L 11/4088; A47L 11/282
See application file for complete search history.

(56) References Cited

U.S. PATENT DOCUMENTS 6,425,958 B1 * 7/2002 Giddings ..... A47L 11/4088 15/345
2002/0170137 A1 * 11/2002 Coates ..... A47L 11/03 15/320

* cited by examiner

*Primary Examiner* — Michael D Jennings
(74) *Attorney, Agent, or Firm* — Bayramoglu Law Offices LLC

(57) ABSTRACT

The present disclosure discloses a floor cleaning apparatus, comprises a cleaning robot and a washing base, and the cleaning robot comprises a robot main body and a mop assembly; the mop assembly is provided with a turntable-type mop mechanism able to stretch out downwards; the washing base comprises an outer container, a rinse tank and a solution-feeding mechanism. In the technical scheme disclosed, the automatic floor cleaning and finishing cloth washing are achieved so as to realize intelligent automatic cleaning, effectively removing dirt attached to the finishing cloth automatically, and freeing from artificially detaching and then washing the finishing cloth stained with dirt, automatically performing washing operation, and greatly alleviating operation burden of a user. Meanwhile, with the structure of the finishing cloth with a lifting structure, secondary pollution caused by the finishing cloth is avoided.

12 Claims, 10 Drawing Sheets

FLOOR CLEANING APPARATUS

CROSS-REFERENCE TO RELATED APPLICATIONS

This application claims priority to Chinese Patent Application No. 201910202088.8 with a filing date of Mar. 18, 2019. The content of the aforementioned application, including any intervening amendments thereto, are incorporated herein by reference.

TECHNICAL FIELD

The present disclosure relates to the technical field of automatic cleaning apparatuses, in particular to a floor cleaning apparatus.

BACKGROUND

With functions of automatic floor sweeping, dust collection and the like, a robot sweeper has been more and more widely used in our family. However, it is deeply troubled by that a finishing cloth of the existing robot sweeper is incapable of perfectly cleaning the floor but only contacting the floor all along, and is inconvenient to clean due to need of artificial assembly and disassembly, which therefore increases the cleaning burden of a user. But if the finishing cloth is not cleaned, the dirty finishing cloth will be continuously used to sweep the floor by the robot sweeper, causing secondary pollution.

SUMMARY

One objective of the present disclosure is to overcome the shortcomings of the prior arts by providing a floor cleaning apparatus capable of automatically removing dirt attached to the finishing cloth, for the purpose of overcoming the foregoing technical defects. The technical solution of the present disclosure is as follows:

A floor cleaning apparatus, comprises a cleaning robot and a washing base, and the cleaning robot comprises a robot main body and a mop assembly arranged at the rear of the robot main body in a lifting manner; the mop assembly is provided with at least one turntable-type mop mechanism capable of downward stretching out of the lower end surface of the robot main body. The washing base comprises an outer container, and a rinse tank and a solution-feeding mechanism that are mounted within the outer container. The outer container has an opening from which the rinse tank is exposed. When the cleaning robot stays above the rinse tank, the finishing cloth at the bottom of the turntable-type mop mechanism downward stretches into the rinse tank and rotates along with the turntable-type mop mechanism. The rinse tank is internally provided with at least one washing component for washing a finishing cloth at a rotating state. The at least one washing component is communicated with the solution-feeding mechanism respectively.

Preferably, the washing component has a hollow inside and is communicated with the solution-feeding mechanism. Spray holes facing the finishing cloth are formed in the washing component. At least one group of bristles is erected on the washing component for cleaning the finishing cloth at a rotation state after wetted by a solution sprayed from the spray holes. The washing component is also provided with a scraping plate for scraping the solution remaining on the finishing cloth.

Preferably, the washing component is of a tubular structure as a whole, one end of the washing component is communicated with the solution-feeding mechanism through a joint pipe, the upper end surface of the washing component sinks to form at least one spraying trough in which at least one spray hole is formed along the length direction of the washing component, the left and right sides of the spray hole are respectively erected with a group of bristles, the upper end surface of the washing component is also provided with a scraping plate, and at least one side of the scraping plate is of a bevel structure.

Preferably, the solution-feeding mechanism comprises a cleaning solution case and a first flow control unit that are communicated with each other, and the first flow control unit is communicated with the washing component through a joint pipe.

The outer container is also internally provided with a sewage treatment mechanism that is communicated with the rinse tank through a joint pipe.

Preferably, the cleaning robot is internally provided with a lifting component. The mop mechanism is comprised by a housing stand of which the upper end is in transmission connection with the output end of the lifting component, a drive motor vertically mounted on the housing stand, at least one turntable-type mop mechanism having a finishing cloth at its lower end, and a transmission mechanism in transmission connection with the output end of the drive motor and the turntable-type mop mechanism.

Preferably, in the robot main body, there further provides a water supply component that comprises a water tank, a flow control mechanism and a plurality of nozzles which are successively communicated through joint pipes, and the nozzles stretch into the turntable-type mop mechanism and are located right above the finishing cloth.

Preferably, the turntable-type mop mechanism comprises a rotary plate, a finishing cloth detachably mounted on the bottom of the rotary plate and a rotary connector connected to the upper end surface of the rotary plate, and the rotary connector is connected onto the housing stand through a bearing and an elastic element is further embedded between the rotary plate and the rotary connector.

Preferably, a circle of annular trough is formed on the upper end surface of the rotary plate, a plurality of liquid holes are evenly, annularly formed in the annular trough, and the outlets of the nozzles are right above the annular trough.

Preferably, on the housing stand, a lifting plate is erected. An internal spline is mounted in the lifting plate. The lifting component comprises a lifting motor secured in the robot main body, a driving gear sheathing the output shaft of the lifting motor, and a transmission gear mounted in the robot main body through a rotary shaft and meshed with the driving gear. Both the driving gear and the transmission gear are embedded in the internal spline and meshed with internal toothed racks at two sides of the internal spline respectively.

Preferably, two turntable-type mop mechanisms are disposed in parallel. The transmission mechanism comprises a first gear plate and a second gear plate that are meshed with each other, and two third gear plates sheathing two rotary connectors. The central shafts of the first gear plate and the second gear plate are in transmission connection onto the housing stand through bearings respectively. The lower ends of the first and second gear plates are respectively meshed with tooth column structure of the two third gear plates. The first gear plate is also meshed with an output gear sheathing the shaft end of the drive motor. The above technical solution has the following beneficial effects:

The floor cleaning apparatus comprises a cleaning robot and a washing base, the cleaning robot comprises a robot main body and a mop assembly, and the washing base comprises an outer container, a rinse tank and a solution-feeding mechanism. Therefore, automatic floor cleaning and finishing cloth washing are achieved so as to realize intelligent automatic cleaning, effectively removing dirt attached to the finishing cloth automatically, and freeing from artificially detaching and then washing the finishing cloth stained with dirt, automatically performing washing operation, and greatly alleviating operation burden of a user. Meanwhile, by virtue of the finishing cloth with a lifting structure, secondary pollution caused by the finishing cloth that is never cleaned is avoided, and the floor cleaning effect is better.

DETAILED DESCRIPTION OF THE DRAWINGS

DETAILED DESCRIPTION OF THE EMBODIMENTS

Figure 1:
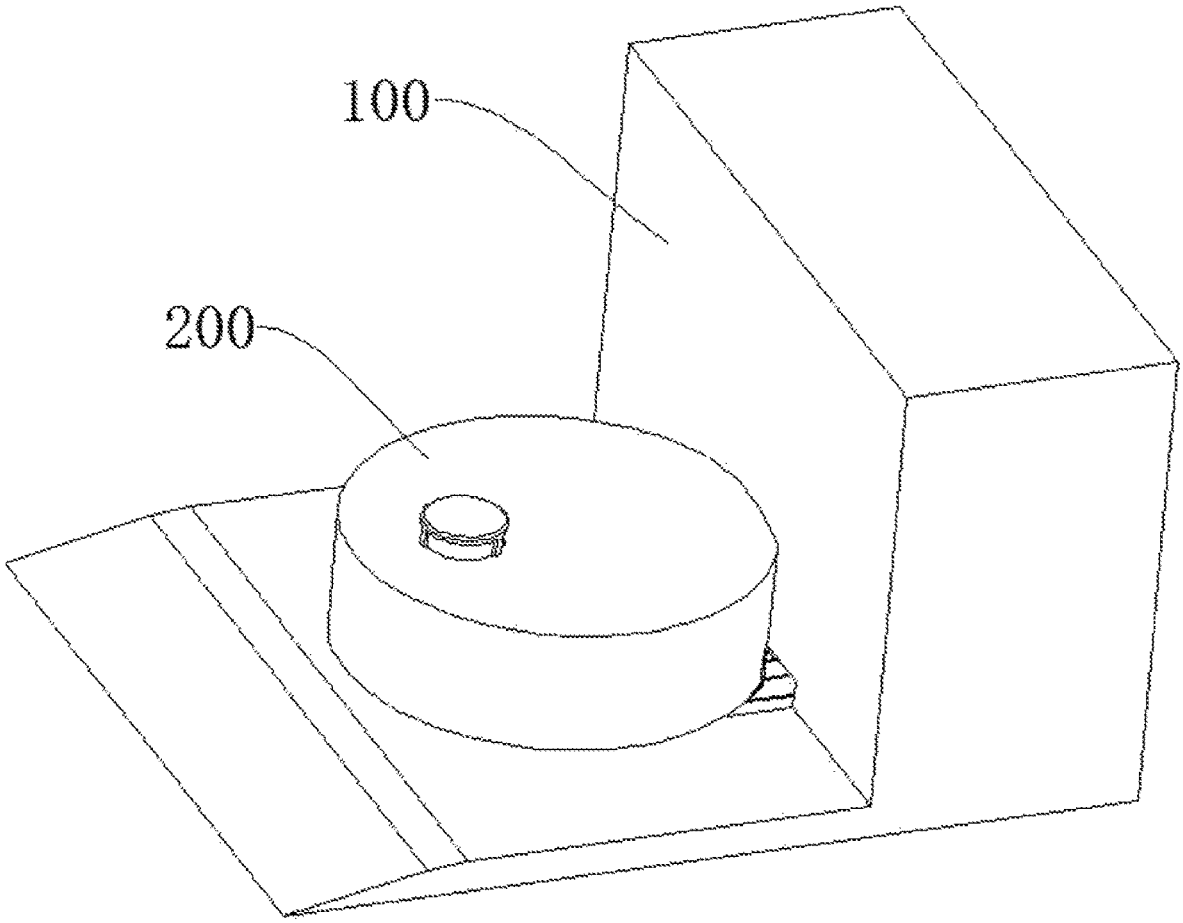
FIG. 1 is a stereogram of a floor cleaning apparatus of the present disclosure.
Figure 2:
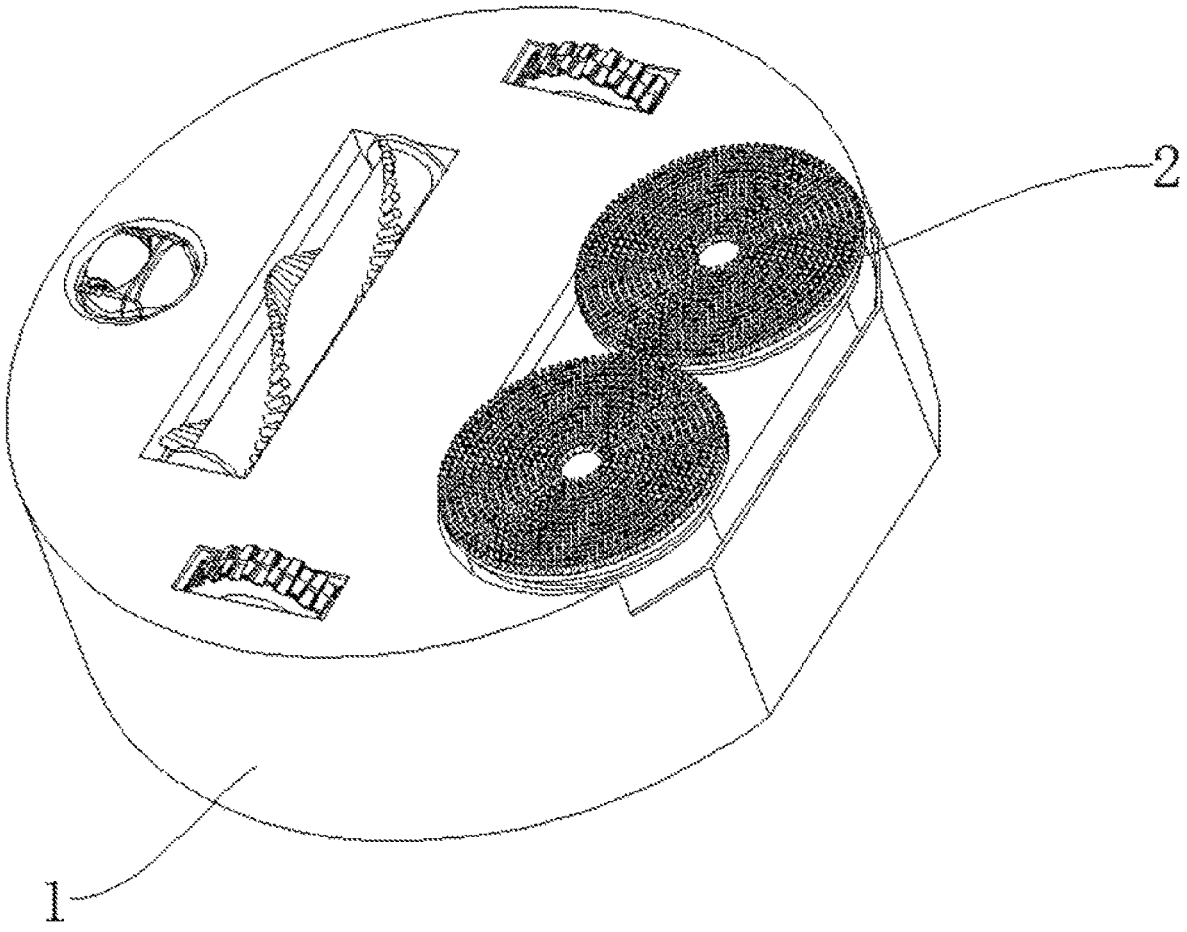
FIG. 2 is a stereogram of a cleaning robot of the floor cleaning apparatus of the present disclosure.
Figure 3:
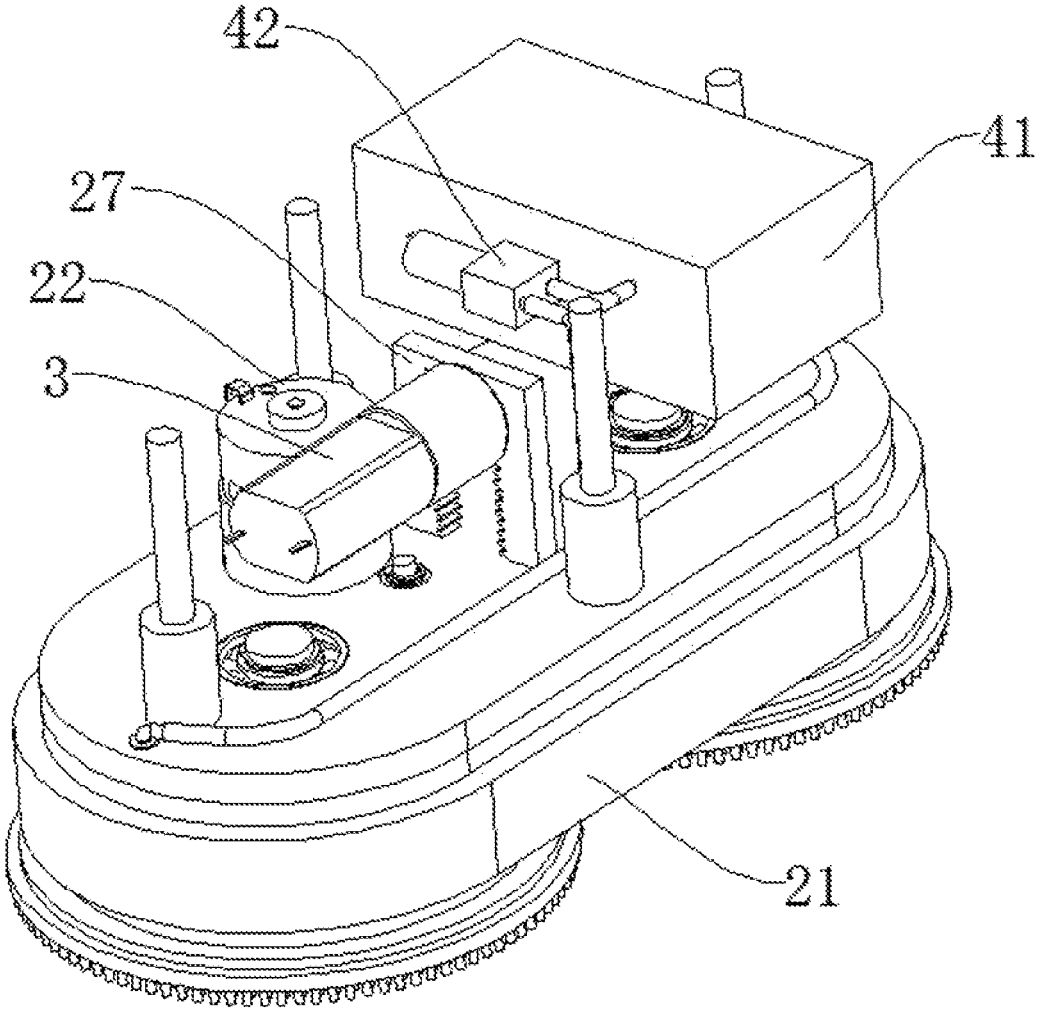
FIG. 3 is a stereogram showing a mop assembly and a lifting component in the cleaning robot of the floor cleaning apparatus of the present disclosure.
Figure 4:
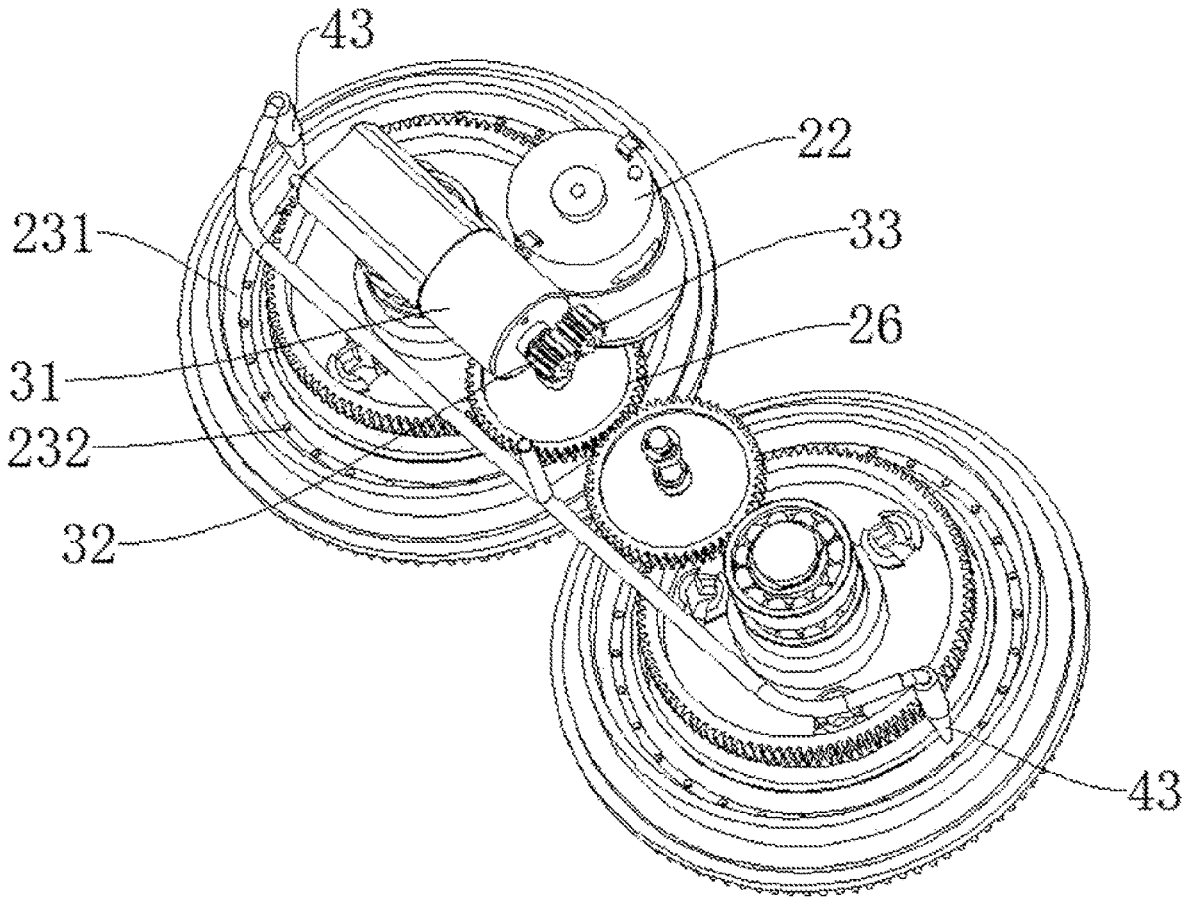
FIG. 4 is a stereogram showing an internal structure of FIG. 3, with a housing stand removed.
Figure 5:
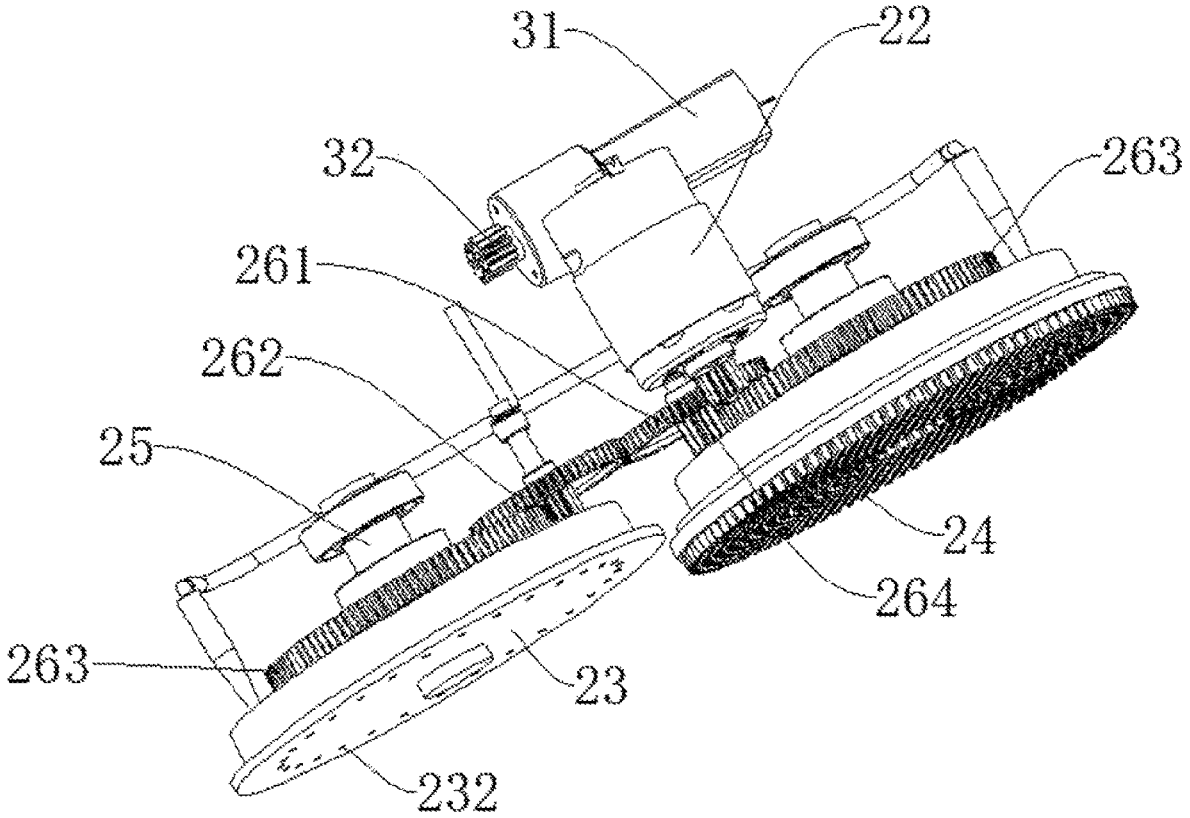
FIG. 5 is a stereogram of the internal structure of FIG. 3, with a housing stand removed but viewed from another angle.

For easy understanding of the technical means, creative features, objects to be achieved and effects of the present disclosure, detailed explanation will be further given in the following embodiments by reference to the accompanying figures.

As shown in FIGS. 1-10, a floor cleaning apparatus provided by the present disclosure, comprises a cleaning robot 200 and a washing base 100, and the cleaning robot 200 comprises a robot main body 1 and a mop assembly 2 arranged at the rear of the robot main body 1 in a lifting manner. The mop assembly 2 is provided with at least one turntable-type mop mechanism capable of downward stretching out of the lower end surface of the robot main body 1. The washing base 100 comprises an outer container, and a rinse tank 7 and a solution-feeding mechanism 5 that are mounted within the outer container, and the outer container has an opening from which the rinse tank 7 is exposed. When the cleaning robot 200 stays above the rinse tank 7, a finishing cloth 24 at the bottom of the turntable-type mop mechanism may downward extend into the rinse tank 7 and rotate along with the turntable-type mop mechanism. The rinse tank 7 is internally provided with at least one washing component 71 for washing the finishing cloth 24 at a rotating state. The at least one washing component 71 is communicated with the solution-feeding mechanism 5 respectively.

Based on the above technical solution, the floor cleaning apparatus comprises a cleaning robot 200 and a washing base 100, the cleaning robot 200 comprises a robot main body 1 and a mop assembly 2, and the washing base 100 comprises an outer container, a rinse tank 7 and a solution-feeding mechanism 5. Therefore, automatic floor cleaning and finishing cloth washing are achieved so as to realize intelligent automatic cleaning, effectively removing dirt attached to the finishing cloth automatically, and freeing from artificially detaching and then washing the finishing cloth stained with dirt, automatically performing washing operation, and greatly alleviating operation burden of a user. Meanwhile, by virtue of the finishing cloth with a lifting structure, secondary pollution caused by the finishing cloth that is never cleaned is avoided, and the floor cleaning effect is better.

Figure 7:
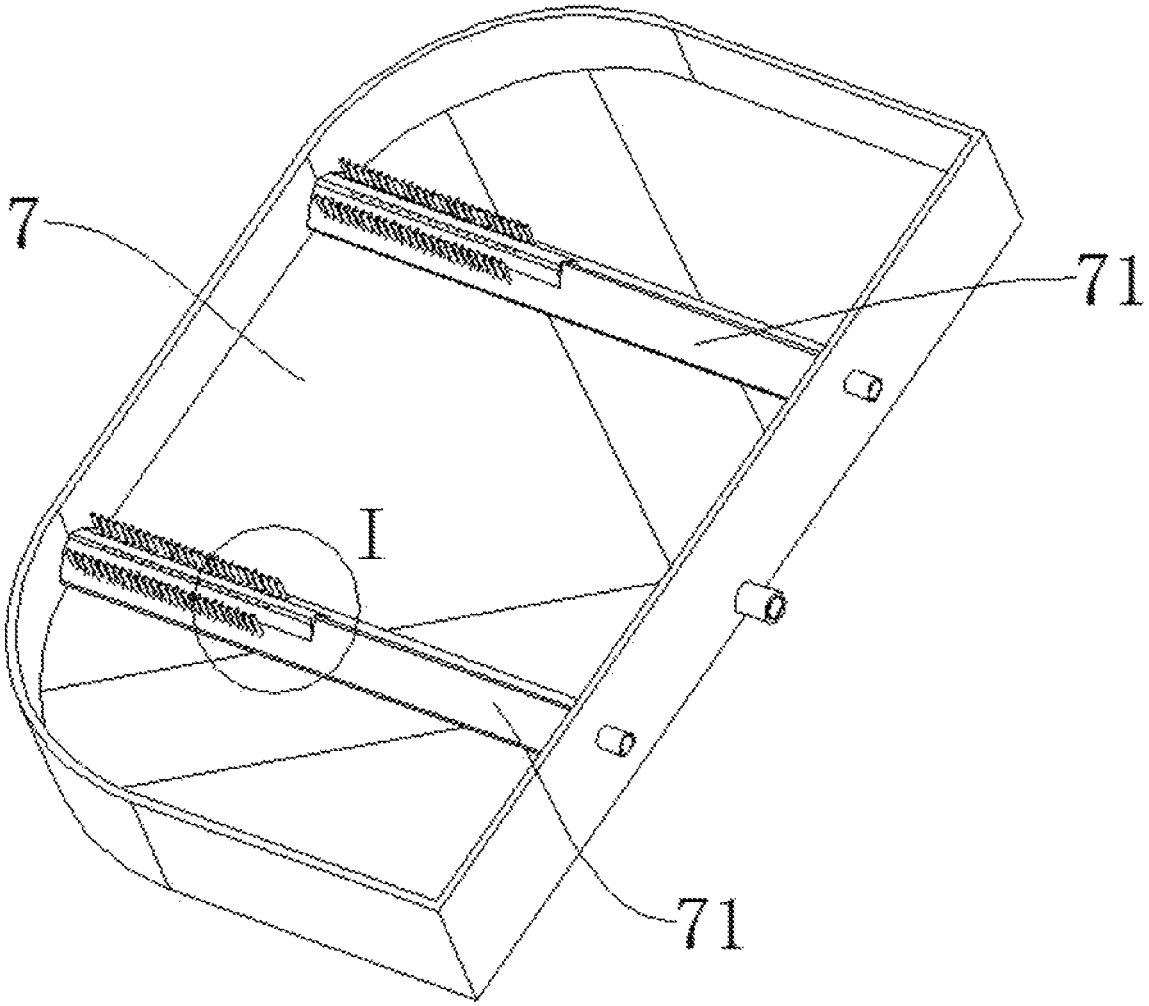
FIG. 7 is a stereogram showing a rinse tank in the washing base of the floor cleaning apparatus of the present disclosure.
Figure 8:
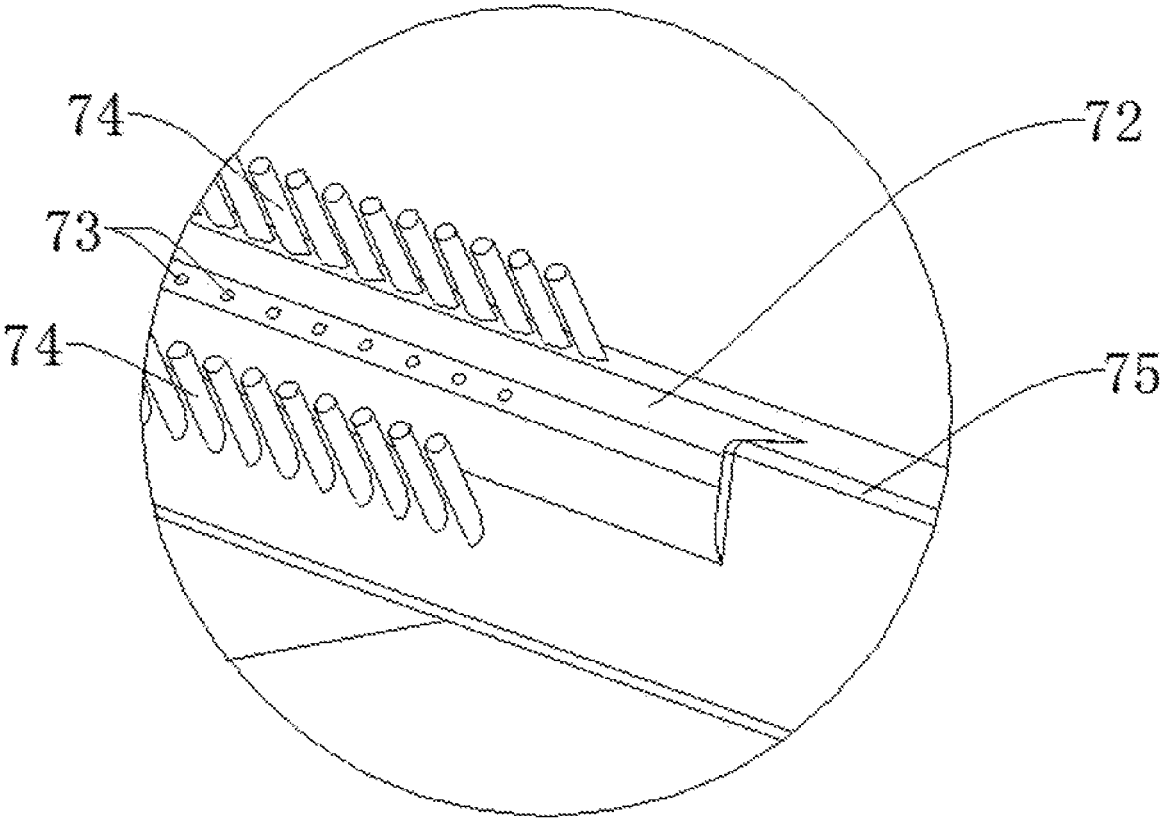
FIG. 8 is a partial enlarged view of portion I in FIG. 7.
Figure 9:
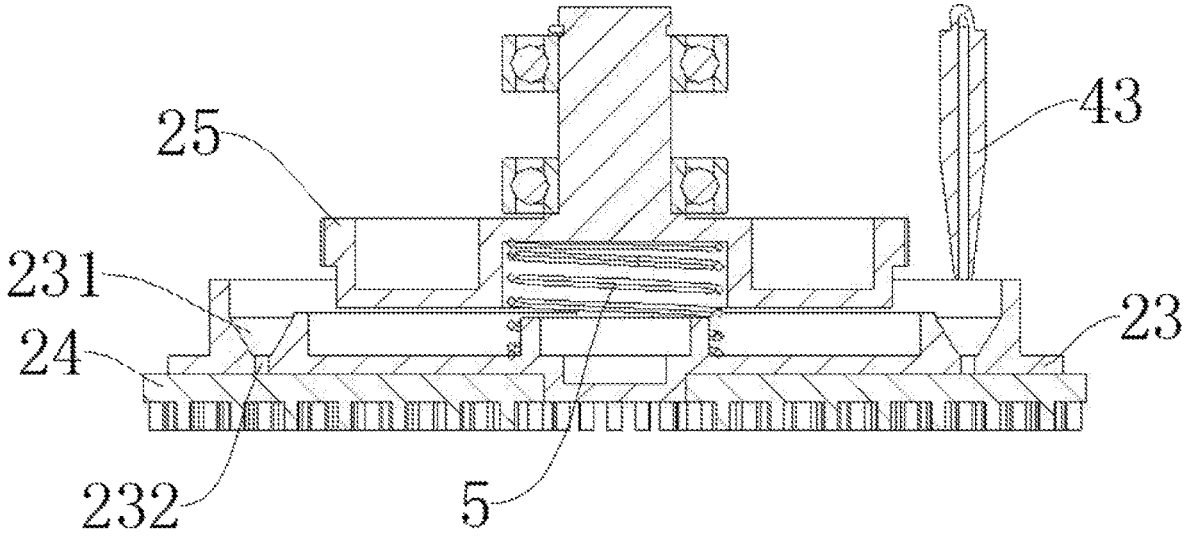
FIG. 9 is a section view of a turntable-type mop mechanism in the cleaning robot of the floor cleaning apparatus of the present disclosure.

In a preferred embodiment, as shown in FIGS. 7 and 8, the washing component 71 has a hollow inside and is communicated with the solution-feeding mechanism 5. Spray holes 73 facing the finishing cloth 24 are formed in the washing component 71. At least one group of bristles 74 is erected on the washing component 71 for washing the finishing cloth 24 at a rotation state after wetted by a solution sprayed from the spray holes 73. The washing component 71 is also provided with a scraping plate 75 for scraping the solution remaining on the finishing cloth 24. The washing component 71 is capable of wetting the finishing cloth 24 by spraying a solution, removing dirt by friction and scraping the remaining solution. In addition, the entire washing component 71 is tubular, one end is communicated with the solution-feeding mechanism 5 through a joint pipe, the upper end surface of the washing component 71 sinks to form at least one spraying trough 72, the spraying trough 72 is internally provided with at least one spray hole 73 along the length direction of the washing component 71, both the left and right sides of the spray hole 73 are respectively erected with a group of bristles 74 (it is permissible that the group of bristles 74 is erected on one side), the upper end surface of the washing component 71 is also provided with a scraping plate 75 at least one side of which presents in the shape of a bevel (it is preferable that both sides are bevels), so that when the finishing cloth 24 rotating along with the rotary plate moves above the washing component 71, solution spraying, friction for dirt remove and remaining solution and dirt scraping operations are carried out on the finishing cloth 24 respectively by the spray holes 73, the group of bristles 74 and the scraping plate 75 at intervals, therefore, cleaning is convenient and its effect is good. Specifically, there provide a spraying trough 72 and a scraper for the washing component 71 in this embodiment, however, more than one spraying trough 72 and more than one washing component 71 that are separately spaced apart are also allowed. Meanwhile, the quantities of the spray holes 73 and the bristles 74 depend on the requirements of actual production.

Figure 6:
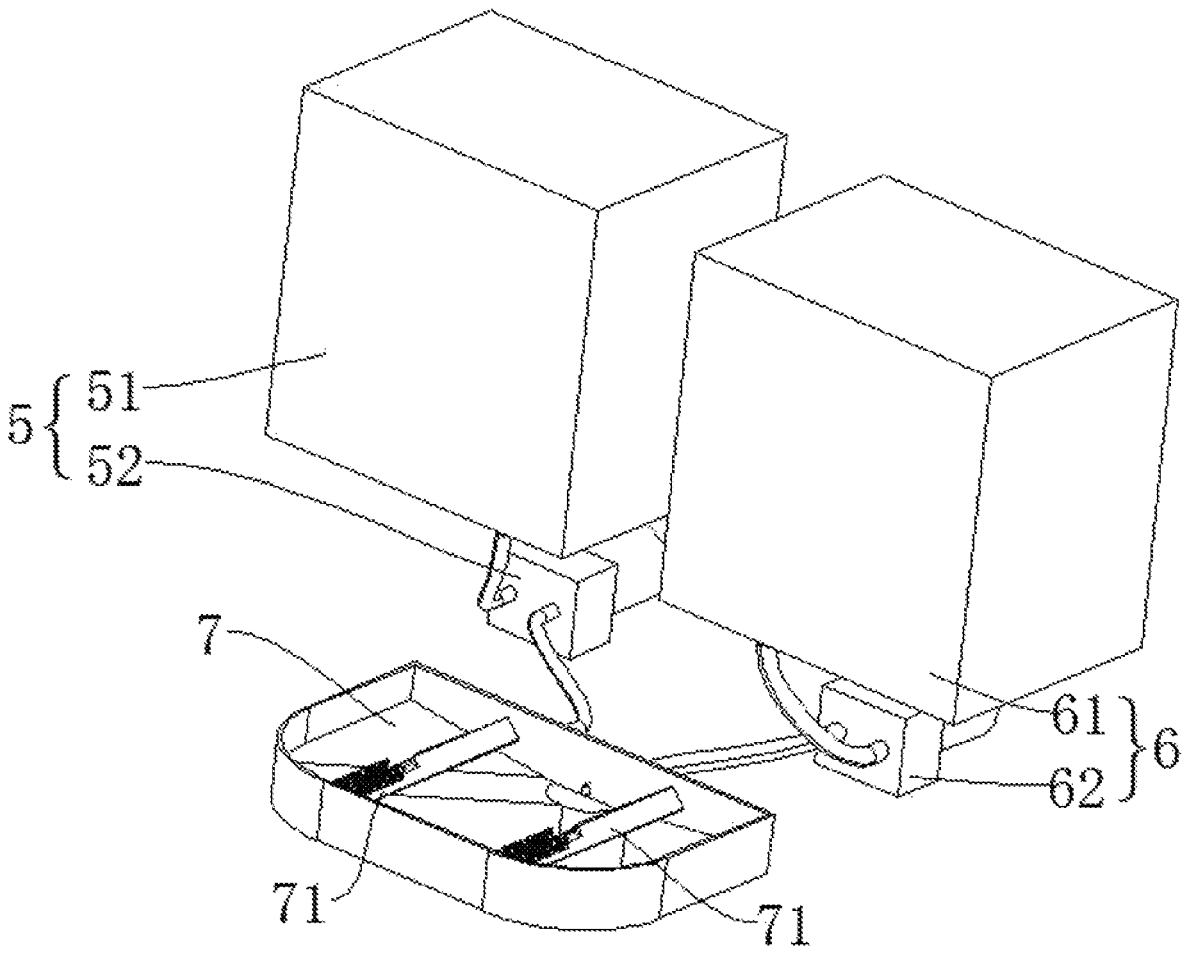
FIG. 6 is a stereogram showing an internal structure of a washing base of the floor cleaning apparatus in the present disclosure.

As a further preferred embodiment, in conjunction with FIG. 6, the solution-feeding mechanism 5 comprises a cleaning solution case 51 and a first flow control unit 52 that are communicated with each other, and the first flow control unit 52 is communicated with the washing component 71 through a joint pipe. To be specific, the cleaning solution case 51 may be used for containing clear water or a cleaning solution. The solution-feeding mechanism 5 may be a faucet connected to an external water pipe, but is not limited thereto. Further, the outer container is also internally provided with a sewage treatment mechanism 6 that is communicated with the rinse tank 7 through a joint pipe. In this embodiment, the sewage treatment mechanism 6 comprises a sewage tank 61 and a second flow control unit 62 that are communicated, the second flow control unit 62 is communicated with the inside of the rinse tank 7 through a joint pipe. The above two flow control units may be water pumps, and the first flow control unit may be a valve of any type for realizing supply/stop of liquid flow. Apparently, a sewage pipe may be directly used as the above sewage treatment mechanism 6. Further, an outer shell is substantially L-shaped, with its front side being a slope, therefore, the cleaning robot 200 can move to the top of the rinse tank 7.

In a preferred embodiment, as shown in FIGS. 2-5, the cleaning robot 200 is internally provided with a lifting component 3. The mop mechanism is comprised by a housing stand 21 of which the upper end is in transmission connection with the output end of the lifting component 3 for achieving ascending and descending of the mop mechanism, a drive motor 22 vertically mounted on the housing stand 21, at least one turntable-type mop mechanism having a finishing cloth 24 at the lower end, and a transmission mechanism 26 in transmission connection with the output end of the drive motor 22 and the turntable-type mop mechanism. Further, the upper end surface of the housing stand 21 is erected with a plurality of guide columns penetrating through the robot main body 1 to play a part in vertical limitation and guiding.

Figure 10:
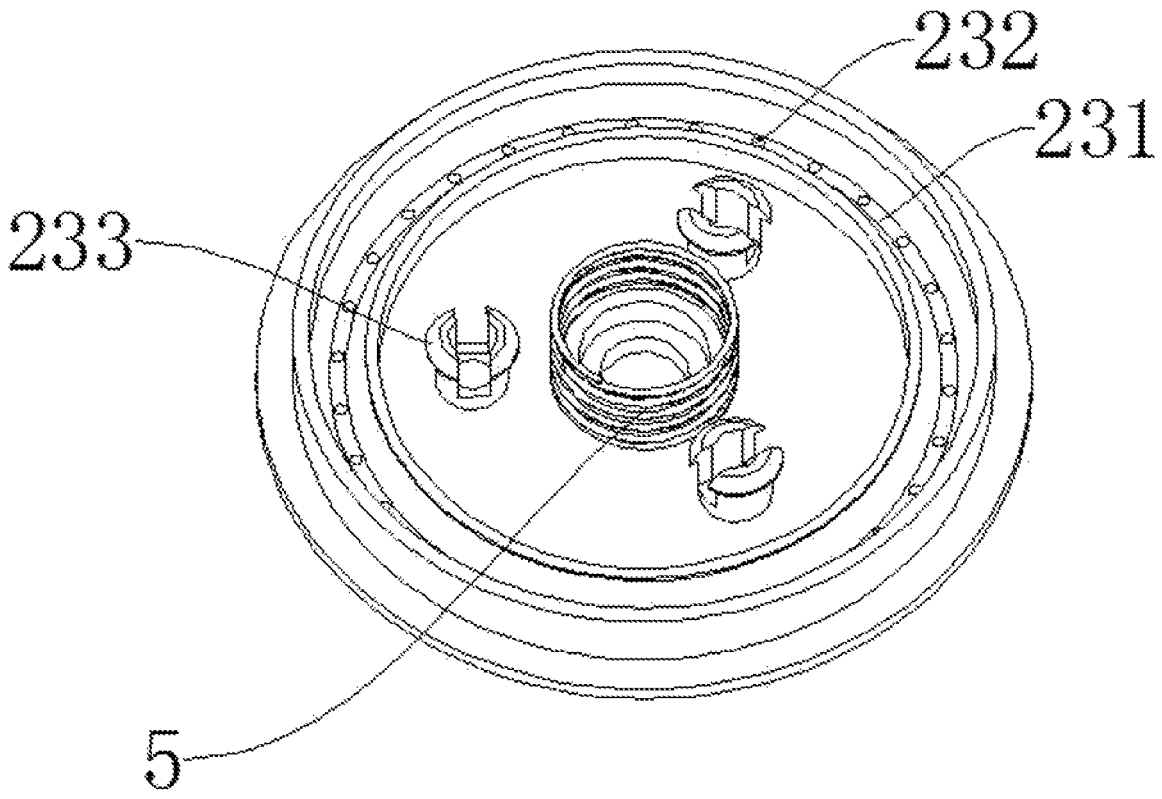
FIG. 10 is a stereogram of a rotary plate in the turntable-type mop mechanism of the cleaning robot of the floor cleaning apparatus in the present disclosure.

As a further preferred embodiment, in the robot main body 1, there further provides a water supply component that comprises a water tank 41, a flow control mechanism 42 and a plurality of nozzles 43 which are successively communicated through joint pipes, and the nozzles 43 stretch into the turntable-type mop mechanism and are located right above the finishing cloth 24. Moreover, referring to FIGS. 9 and 10, the turntable-type mop mechanism comprises a rotary plate 23, a finishing cloth 24 detachably mounted on the bottom of the rotary plate 23 and a rotary connector 25 connected to the upper end surface of the rotary plate 23, and the rotary connector 25 is connected onto the housing stand 21 through a bearing and an elastic element 5 is further embedded between the rotary plate 23 and the rotary connector 25. On the one hand, the finishing cloth 24 is always clung to the uneven floor when the cleaning robot 200 operates, and is clung to the scraping plate 75 when cleaned in the rinse tank 7 on the other hand. Therefore, the effect of scraping sewage and remaining solution is enhanced. The elastic element 5 is a spring, or may be selected from other similar components such as a rubber elastic pin. Further, a plurality of limit connection columns 233 are also erected on the upper end surface of the rotary plate 23 and provided with mounting holes of which the quantity is as same as to that of the limit connection columns 233 and the positions are oppose to the limit connection columns 233. The upper ends of the limit connecting columns 233 penetrating through the mounting holes are provided with limit parts to firmly limit the two into a whole and allow the rotary connector 25 to vertically move. To be specific, as shown in FIG. 10, the limit part is of an elastic structure of which the center has a through groove and the outer fringe of the upper end is of a tapered circular structure. Due to self-elasticity of rubber, the limit part can be conveniently assembled, or assembled by other ways, such as, but not limited to, screwing a fastening nut on the upper end to serve the above purpose.

As a further preferred embodiment, a circle of annular trough 231 is formed on the upper end surface of the rotary plate 23, a plurality of liquid holes 232 are evenly, annularly formed in the annular trough 231, and the outlets of the nozzles 43 are right above the annular trough 231 so that clear water flows in the annular trough 231 to the finishing cloth 24 below through the liquid holes 232 to wet the finishing cloth 24 in cleaning the floor. Further, on the housing stand 21, a lifting plate 27 is erected. An internal spline is mounted in the lifting plate 27. The lifting component 3 comprises a lifting motor 31 secured in the robot main body 1, a driving gear 32 sheathing the output shaft of the lifting motor 31, and a transmission gear 33 mounted in the robot main body 1 through a rotary shaft and meshed with the driving gear 32. Both the driving gear 32 and the transmission gear 33 are embedded in the internal spline and meshed with internal toothed racks at two sides of the internal spline respectively. Therefore, the effect of steady lifting is achieved, which is also can be realized by means of at least one electric push rod or other transmission parts.

As a further preferred embodiment, two turntable-type mop mechanisms are disposed in parallel. The transmission mechanism 26 comprises a first gear plate 261 and a second gear plate 262 that are meshed with each other, and two third gear plates 263 sheathing two rotary connectors 25. The central shafts of the first gear plate 261 and the second gear plate 262 are in rotary connection on the housing stand 21 through bearings respectively. The lower ends of the first gear plate 261 and the second gear plate 262 are respectively meshed with tooth column structure 264 of the two third gear plates 263. The first gear plate 261 is also meshed with an output gear sheathing the shaft end of the drive motor 22 to realize gear retarding and transmission. Meanwhile, two nozzles are correspondingly provided, which extend into two rotary plates 23 respectively. However, more nozzles are also permissible so as to enhance water supply effect. Besides, the robot main body 1 of the cleaning robot 200 also comprises rollers, a suction inlet, a rolling brush, a radar unit and other conventional components, for achieving functions of self-operation and cleaning of the cleaning robot 200. The robot main body 1 is internally provided with a central control system electrically connected with the above-mentioned all electric components therein to achieve united control. The washing base 100 is also internally provided with a controller for controlling the two flow control units, and a pressure sensor or an infrared sensor for detecting whether the cleaning robot 200 is in place or not so as to automatically supply the solution for washing. Detailed description about the above components is not given as they are conventional ones. The above finishing cloth 24 is directly adhered to the bottom of the rotary plate 23, detachably connected by magnetic blocks, connected by fasteners, or the like.

In specific use, when the cleaning robot 200 cleans the floor, the turntable-type mop mechanism descends to touch the floor, the water supply component supplies water for wetting the finishing cloth 24 at intervals, and the cleaning robot 200 mops the floor while moving; under the effect of the elastic element 5, the finishing cloth 24 always abuts the uneven floor, the turntable-type mop mechanism upward retracts when floor mopping is performed for a preset period of time (e.g., time is set or the finishing cloth 24 rotates for n circles), the cleaning robot 200 records the position as a breakpoint position and moves to the washing base 100 to perform washing procedure; in the washing procedure, the turntable-type mop mechanism descends to make the finishing cloth 24 stretch into the rinse tank 7 and abut the washing component 71, the rotary plate 23 rotates, under the effect of the elastic element 5, the finishing cloth 24 always abuts the scraping plate 75, and the washing component 71 performs the operations of solution spraying, friction washing and scraping remaining water and adhesives with the scraping plate 75; and after washing, the turntable-type mop mechanism ascends and moves to the breakpoint position to perform the operation of cleaning the floor once again, and so forth.

The above merely provides the preferred embodiments of the present disclosure, which is illustrative, rather than restrictive, to the present disclosure. However, it should be understood by those skilled in the art that, many variations, modifications even substitutions that do not depart from the spirit and scope defined by claims of the present disclosure, shall fall into the extent of protection of the present disclosure.

What is claimed is:

1. A floor cleaning apparatus, comprising:

a cleaning robot, and a washing base, wherein the cleaning robot comprises a robot main body and a mop assembly arranged at a rear of the robot main body in a lifting manner; the mop assembly is provided with at least one turntable-type mop mechanism able to stretch downwards out of a lower end surface of the robot main body;

wherein the washing base comprises:

an outer container, a rinse tank, and a solution-feeding mechanism, the rinse tank and the solution-feeding mechanism are mounted within the outer container;

the outer container has an opening from which the rinse tank is exposed;

when the cleaning robot stays above the rinse tank, a finishing cloth at a bottom of the at least one turntable-type mop mechanism downward stretches into the rinse tank and rotates along with the at least one turntable-type mop mechanism;

the rinse tank is internally provided with at least one washing component for washing the finishing cloth at a rotating state;

the at least one washing component is in communication with the solution-feeding mechanism respectively.

2. The floor cleaning apparatus of claim 1, wherein the at least one washing component has a hollow inside and is in communication with the solution-feeding mechanism; spray holes facing the finishing cloth are formed in the at least one washing component; at least one group of first bristles is erected on the at least one washing component for cleaning the finishing cloth at the rotating state after wetted by a solution sprayed from the spray holes; the at least one washing component is also provided with a scraping plate for scraping the solution remaining on the finishing cloth.

3. The floor cleaning apparatus of claim 2, wherein the at least one washing component is of a tubular structure as a whole; one end of which is in communication with the solution-feeding mechanism through a first joint pipe; an upper end surface of the at least one washing component sinks to form at least one spraying trough in which at least one of the spray holes is formed along a length direction of the at least one washing component, a left side and a right side of the at least one of the spray holes are respectively erected with a group of second bristles, the upper end surface of the at least one washing component is also provided with the scraping plate, and at least one side of the scraping plate is of a bevel structure.

4. The floor cleaning apparatus of claim 2, wherein the solution-feeding mechanism comprises a cleaning solution case and a first flow control unit that are in communication with each other, and the first flow control unit is in communication with the at least one washing component through a second joint pipe; the outer container is also internally provided with a sewage treatment mechanism that is in communication with the rinse tank through a third joint pipe.

5. The floor cleaning apparatus of claim 3, wherein the solution-feeding mechanism comprises a cleaning solution case and a first flow control unit that are in communication with each other, and the first flow control unit is in communication with the at least one washing component through a second joint pipe; the outer container is also internally provided with a sewage treatment mechanism that is in communication with the rinse tank through a third joint pipe.

6. The floor cleaning apparatus of claim 1, wherein the cleaning robot is internally provided with a lifting component; the at least one turntable-type mop mechanism comprises:

a housing stand, of which an upper end is in transmission connection with an output end of the lifting component;

a drive motor, vertically mounted on the housing stand;

the at least one turntable-type mop mechanism having the finishing cloth at its lower end, and a transmission mechanism, in transmission connection with an output end of the drive motor and the at least one turntable-type mop mechanism.

7. The floor cleaning apparatus of claim 6, wherein in the robot main body, there further provides a water supply component that comprises a water tank, a flow control mechanism and a plurality of nozzles which are successively communicated through fourth joint pipes, and the plurality of nozzles stretch into the at least one turntable-type mop mechanism and are located right above the finishing cloth.

8. The floor cleaning apparatus of claim 7, wherein the at least one turntable-type mop mechanism comprises a rotary plate, the finishing cloth detachably mounted on a bottom of the rotary plate and a rotary connector connected to an upper end surface of the rotary plate, and the rotary connector is connected onto the housing stand through a bearing and an elastic element is further embedded between the rotary plate and the rotary connector.

9. The floor cleaning apparatus of claim 8, wherein a circle of annular trough is formed on the upper end surface of the rotary plate, a plurality of liquid holes are evenly, annularly formed in the circle of annular trough, and outlets of the plurality of nozzles are right above the circle of annular trough.

10. The floor cleaning apparatus of claim 9, wherein in the housing stand, a lifting plate is erected; an internal spline is formed in the lifting plate and the lifting component comprises a lifting motor secured in the robot main body, a driving gear sheathing the output shaft of the lifting motor, and a transmission gear mounted in the robot main body through a rotary shaft and meshed with the driving gear; both the driving gear and the transmission gear are embedded in the internal spline and meshed with internal toothed racks at two sides of the internal spline respectively.

11. The floor cleaning apparatus of claim 6, wherein in the housing stand, a lifting plate is erected; an internal spline is formed in the lifting plate and the lifting component comprises a lifting motor secured in the robot main body, a driving gear sheathing the output shaft of the lifting motor, and a transmission gear mounted in the robot main body through a rotary shaft and meshed with the driving gear; both the driving gear and the transmission gear are embedded in the internal spline and meshed with internal toothed racks at two sides of the internal spline respectively.

12. The floor cleaning apparatus of claim 6, wherein two of the at least one turntable-type mop mechanisms are arranged in parallel; the transmission mechanism comprises a first gear plate and a second gear plate that are meshed with each other, and two third gear plates sheathing two rotary connectors; central shafts of the first gear plate and the second gear plate are in transmission connection onto the housing stand through bearings respectively; a lower end of the first gear plate and a lower end of the second gear plate are respectively meshed with tooth column structure of the two third gear plates; the first gear plate is also meshed with an output gear sheathing a shaft end of the drive motor.

* * * * *